United States Patent [19]

Richter et al.

[11] 4,149,132

[45] Apr. 10, 1979

[54] METHOD OF MANUFACTURING AN ELECTROMAGNET

[75] Inventors: Hermann Richter; Wendelin Weber, both of Siegen, Fed. Rep. of Germany

[73] Assignee: U.S. Philips Corporation, New York, N.Y.

[21] Appl. No.: 839,653

[22] Filed: Oct. 5, 1977

[30] Foreign Application Priority Data

Nov. 6, 1976 [DE] Fed. Rep. of Germany ..... 2650873

[51] Int. Cl.[2] ..... H01F 7/16; C25D 5/50; C25D 5/34

[52] U.S. Cl. ..... 335/262; 204/25; 204/32 R; 204/37 R; 204/385

[58] Field of Search ..... 204/25, 26, 32 R, 37 R, 204/38 S; 335/261, 262; 197/1 R

[56] References Cited

U.S. PATENT DOCUMENTS

| | | | |
|---|---|---|---|
| 3,225,159 | 12/1965 | Fluder et al. | 335/261 |
| 3,505,628 | 4/1970 | Allen | 335/262 |
| 3,672,964 | 6/1972 | Bellis | 204/38 S |
| 3,751,345 | 8/1973 | Wilhelm et al. | 204/37 R |
| 4,051,941 | 10/1977 | Herbert | 197/1 R |

*Primary Examiner*—John H. Mack
*Assistant Examiner*—William Leader
*Attorney, Agent, or Firm*—Carl P. Steinhauser

[57] ABSTRACT

A method of manufacturing an electro-magnet, comprising two tubular poleshoes which are coaxially arranged with respect to each other and in which an armature is slidable, the inner surface of the poleshoes and the outer surface of the armature being successively degreased and pickled, after which they are provided with a nickel layer by electroplating, and a nickel phosphide layer formed by electroless deposition of a nickel-phosphorus layer which is converted to nickel-phosphide by heating to about 400° C. The electromagnets manufactured by means of the method in accordance with the invention are particularly suitable for us in matrix printers.

6 Claims, 2 Drawing Figures

METHOD OF MANUFACTURING AN ELECTROMAGNET

The invention relates to a method of manufacturing an electromagnet, comprising two tubular poleshoes which are coaxially arranged with respect to each other and in which an armature is guided which is movable against spring force when a coil arranged around the poleshoes is excited. The invention also relates to an electromagnet manufactured by a method in accordance with the invention.

During the manufacture of electromagnets of the kind set forth (known in principle from British patent specification No. 1,343,233), a problem is encountered in that on the one hand the magnetic air gaps between poleshoes and armature must be minimized, while on the other hand wear of the armature and the poleshoes due to the movement of the armature must also be minimized. Obviously, the criterion in this respect is the choice of the material for the armature and the poleshoes, because increased wear usually causes an increase of the magnetic air gaps.

This problem will be described in detail hereinafter with reference to FIGS. 1 and 2 which show a known electromagnet.

Figure 1:
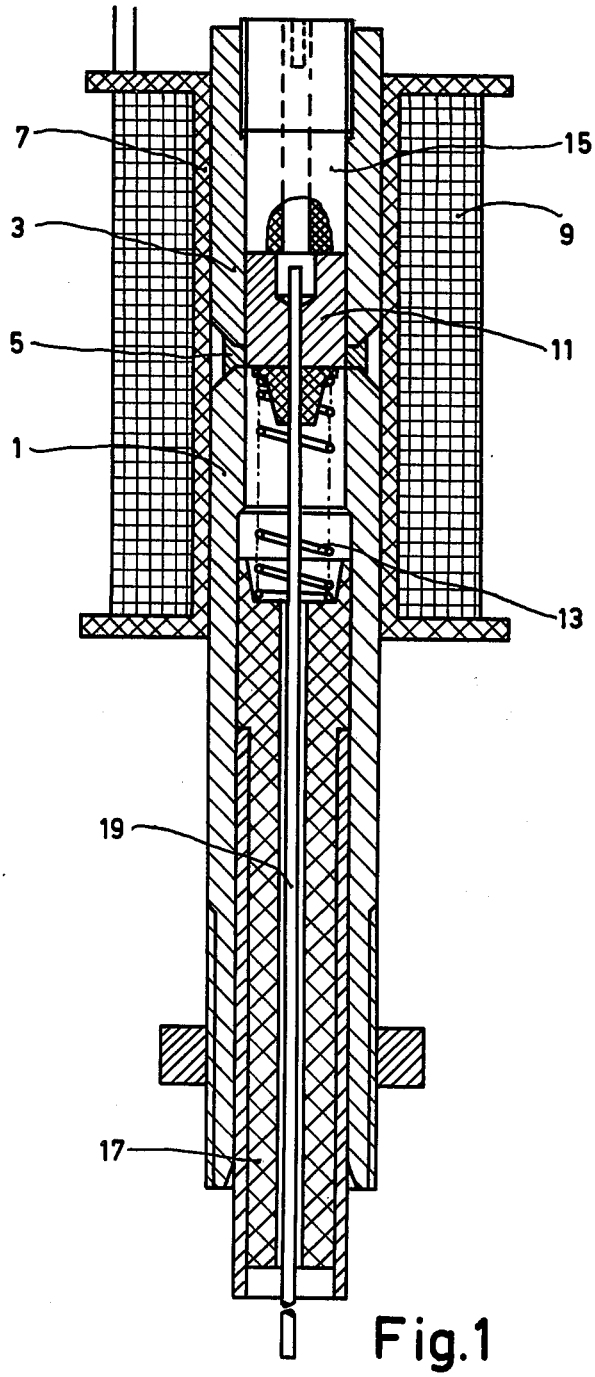

The electromagnet shown in FIG. 1 (known from British patent specification No. 1,343,233) comprises two tubular poleshoes 1 and 3 of a magnetically permeable material which are coaxially arranged with respect to each other. The poleshoes 1 and 3 are magnetically separated from each other by a spacer ring 5 of a magnetically insulating, but preferably electrically conductive material such as, for example copper. Around the poleshoes 1 and 3 a cylinder 7 is symmetrically arranged with respect to the intermediate ring 5, said cylinder supporting an excitation coil 9. In the poleshoes 1 and 3 a circular cylindrical armature 11 of a magnetically permeable material is guided. When the coil 9 is not excited, the armature 11 is biased against an abutment 15 by a helical spring 13. One end of the spring 13 bears against the armature 11 and near its other end against a tubular support 17 secured in the poleshoe 1. In the present case a printing stylus 19 is connected to the armature 11, because the relevant electromagnet serves for use in a so-called matrix printer. In order to maintain the friction occurring between the armature 11, the poleshoes 1 and 3 and the spacer ring 5 within given limits, a small tubular air gap is always required between the armature, the poleshoes and the intermediate ring. However, because the poleshoes and the armature are made of soft iron which is not wear-resistant, said necessary air gap is increased. In the case of prolonged use of the electromagnet, this increase of the air gap causes substantial magnetical losses.

The invention has for its object to provide electromagnets involving comparatively low magnetic losses and comprising a wear-resistant armature and poleshoes.

To this end, in the method in accordance with the invention the inner surfaces of the tubular poleshoes and the outer surface of the armature are pickled, after having been degreased, after which said surfaces are provided with metal nuclei by electro-deposition at a comparatively high current density, the nucleated surfaces subsequently being provided with a comparatively thin layer of nickel-phosphorus by electroless plating, the nickel-phosphorus layer being ultimately rendered magnetically permeable by heating to about 400° C.

In a special method in accordance with the invention, being particularly suitable for the manufacture of electromagnets for matrix printers, the inner surfaces of the poleshoes are nucleated with nickel by electro-deposition for a period of from 15 to 60 seconds at a current density of from 5 to 30 a/dm$^2$, the electroless nickel plating being continued until a layer thickness of from 5 to 15 μm has been obtained.

The invention will be described in detail hereinafter, notably with reference to FIG. 2.

Before the mounting of the soft-iron poleshoes 1 and 3 and the armature 11 in, for example, the electromagnet for matrix printers as shown in FIG. 1, they are degreased in an organic solvent such as, for example, trichloroethylene or tetrachloroethylene, and are subsequently rinsed in water. After degreasing and rinsing, the poleshoes and the armature are pickled and subsequently rinsed in water again. Pickling is performed in a 15% hydrochloric acid solution or in a sulphuric acid solution of at most 90%, but preferably between 5 and 25%. The duration of the pickling treatment is from approximately 10 to 15 seconds.

The pickled poleshoes and armature, after having been rinsed again, are subsequently nucleated with nickel in a nickel electroplating bath which is operated at current densities of between 5 and 30 A per dm$^2$, which are comparatively high values for nickel electroplating. Nickel electroplating is preferably performed for approximately 20 seconds in a bath containing per liter:

120 g nickel sulphate
180 ml of 36% hydrochloric acid
200 ml of 90% sulphuric acid.

The bath temperature equals the ambient temperature, while the current density must be between 10 and 25 A per dm$^2$. Other electroplating baths besides the described nickel electroplating baths are also suitable, for example, a bath containing per liter:

100 g nickel chloride and
950 ml of 36% hydrochloric acid.

This bath is also operated at a room temperature and current densities of between 10 and 25 A per dm$^2$.

After electro-deposition of nickel nuclei on the poleshoes and the armature, they are preferably treated in an electroless nickel-plating bath containing per liter:

19 g nickel sulphate
11.5 g sodium hydroxide
23 g sodium hypophosphite
28 g 98% acetic acid
1 mg lead acetate.

This electroless nickel-plating bath is operated at a temperature of from 85° to 95° C. The pH-value amounts to 4.5–4.7 and the deposition rate varies of from 10 to 20 μm/h. The electroless treatment is continued until a nickel-phosphorus layer having a thickness of from 5 to 15 μm has been obtained.

Besides the described acidic nickel plating bath, it is also possible, for example, to use an alkaline nickel plating bath containing per liter:

30–50 g nickel chloride
10–22.5 g sodium hypophosphite
100 g sodium citrate
50 g ammonium chloride to which a quantity of $NH_4OH$ is added until the pH-value amounts to 8–10. The bath temperature varies from 90° to 100° C. and the deposition rate is 8 μm/h.

The treatment in the alkaline electroless nickel plating bath is also continued until a layer thickness of from 5 to 15 μm has been obtained.

Even though the electroless nickel plating baths described in the foregoing are to be preferred, it is alternatively possible to use known electroless nickel plating baths such as described, for example, in the book by Gawrilow "Chemische Vernickelung," pages 26–29 and pages 46–49.

The known nickel electroplating baths described in the foregoing are operated for the method in accordance with the invention at current densities of from 5–30 A/dm$^2$ which are unheard of thus far. It is only at these high current densities that proper nucleation of the tubular poleshoes is ensured. The nickel layer is preferably deposited only on the parts of the armature, the poleshoes and, if present, the spacer ring which come into frictional contact with each other. This can be realized by the use of masks or chemical neutralization. Even though use is preferably made of electronucleation with nickel, nucleation can also be performed with other metals such as, for example, iron or cobalt. The nucleation metal has only a very limited effect on the magnetic behaviour of the electromagnet.

It is to be noted that the following materials can be added to the electroless nickel plating baths, for example, boron carbide, silicon carbide, aluminum oxide and micro grain diamonds; additives of this kind increase the wear resistance of the nickel-phosphorus layer.

After the electroless nickel plating, the poleshoes, the armature and, if present, the spacer ring are heated above about 400° C. to form nickel-phosphides which are magnetically permeable. The poleshoes and the armature can subsequently be mounted in an electromagnet as shown, for example, in FIG. 1.

Figure 2:
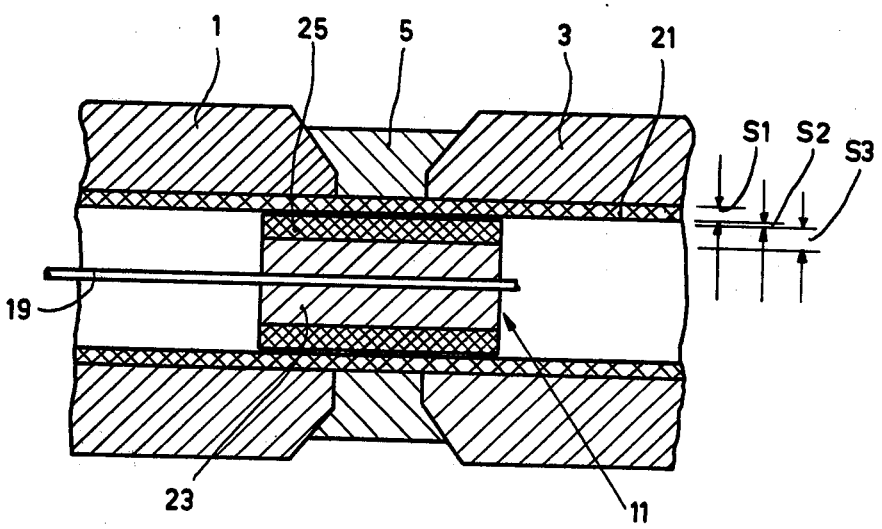

FIG. 2 shows, at an increased scale, a detail of the electromagnet shown in FIG. 1 in the excited condition of the coil 9. The armature 11 is then symmetrically situated relative to the spacer ring 5. The poleshoes 1 and 3 and the spacer ring 5 are provided with a non-interrupted nickel-phosphide layer 21, the armature 11, comprising a soft-iron core 23, being covered with a nickel-phosphide layer 25. The thickness of the nickel-phosphide layers 21 and 25 is exaggerated in FIG. 2. The thicknesses of the nickel-phosphide layers 21 and 25 are denoted by the references $S_1$ and $S_3$, respectively, the dimensions of the tubular air gap being denoted by the reference $S_2$. The nickel-phosphide layers $S_1$ and $S_3$ not only ensure that the poleshoes and the armature are highly wear-resistant, but their magnetic permeability also ensures that they do not contribute to increased magnetic losses. Because, moreover, the nickel-phosphide layer $S_1$ is very thin, the part thereof which is situated at the area of the spacing ring is magnetically saturated when the coil is excited. The effect of this saturation consists in that the magnetic field generated by the coil is forced into the armature. This effect is further enhanced by the spacer ring 5. It will be obvious that the available magnetic field is thus very effectively used, so that smaller coils and/or lower excitation currents are feasible.

The method in accordance with the invention, obviously, is not restricted to electromagnets for matrix printers. Generally, the invention can be successfully used for all electromagnetic devices of the type described in the preamble.

What is claimed is:

1. A method of manufacturing an electromagnet, comprising two coaxial tubular poleshoes and an armature movable within said poleshoes against spring force when a coil arranged around the poleshoes is excited, comprising the steps of degreasing and pickling the inner surfaces of the tubular poleshoes and the outer surface of the armature, electro-depositing metal nuclei on said surfaces at a current density of about 5 to 30 a/dm$^2$, depositing on the nucleated surfaces a layer of nickel-phosphorus having a thickness of about 5 to 15 μm and heating the nickel-phosphorus layer to about 400° C. to render it magnetically permeable.

2. A method as claimed in claim 1, wherein said metal nuclei are nickel and the nickel electro-plating is performed for approximately 15–60 seconds in a bath solution containing 120 g nickel sulphate per liter, 180 ml 36% hydrochloric acid per liter, and 200 ml 90% sulphuric acid per liter, the subsequent electroless nickel plating taking place for a period of from approximately 15 minutes to 45 minutes in a bath solution containing:

19 g/l nickel sulphate
11.5 g/l sodium hydroxide
23 g/l sodium hypophosphite
28 g/l 98% acetic acid
1 mg/l lead acetate
at a temperature of from 85°–95° C.
with a pH-value of from 4.5–4.7.

3. A method of manufacturing an electromagnet as claimed in claim 1, in which the poleshoes are magnetically isolated from each other by an intermediate ring of magnetically insulating material, wherein the inner surface of the poleshoes as well as the outer surface of the intermediate ring are simultaneously provided with a non-interrupted, magnetically permeable layer of nickel-phosphide.

4. An electromagnet comprising two coaxial poleshoes an armature movable within said poleshoes, resilient means restraining movement of said armature, coil means to energize said poleshoes and produce a magnetic field in said poleshoes which moves said armature against said resilient means, the inner surfaces of said poleshoes and outer surface of said armature each having a layer about 5 to 15 μm in thickness of magnetically permeable nickel-phosphide on metal nuclei electro-deposited at current density of from 5 to 30 a/dm$^2$.

5. An electromagnet as claimed in claim 4 in which the metal nuclei are nickel.

6. An electromagnet as claimed in claim 4 for a matrix printer having a stylus secured to said armature.

* * * * *